US005490777A

United States Patent [19]

Matsumoto

[11] Patent Number: 5,490,777

[45] Date of Patent: Feb. 13, 1996

[54] FUEL GAS SUPPLY ADJUSTER

[75] Inventor: Tadahisa Matsumoto, Tokyo, Japan

[73] Assignee: Fujiwara Industrial Co., Ltd., Osaka, Japan

[21] Appl. No.: 127,075

[22] Filed: Sep. 27, 1993

[51] Int. Cl.[6] ..... F23A 14/28

[52] U.S. Cl. ..... 431/344; 222/3; 137/550

[58] Field of Search ..... 431/344; 222/3; 137/544, 549, 550

[56] References Cited

U.S. PATENT DOCUMENTS

| | | | |
|---|---|---|---|
| 3,766,946 | 10/1973 | Corarg . | |
| 4,478,570 | 10/1984 | Johansson | 431/344 |
| 4,496,309 | 1/1985 | Schächter . | |
| 4,680,007 | 7/1987 | Schachter | 431/344 |
| 4,927,747 | 5/1990 | Nitta | 431/344 |
| 4,929,175 | 5/1990 | Nitta | 431/344 |

FOREIGN PATENT DOCUMENTS

| | | | |
|---|---|---|---|
| 47-866 | 1/1972 | Japan . | |
| 54-154874 | 10/1979 | Japan . | |
| 62-5562 | 2/1987 | Japan . | |
| 0238331 | 10/1988 | Japan | 431/344 |
| 2-52770 | 11/1990 | Japan . | |
| WO8203262 | 9/1982 | WIPO . | |

*Primary Examiner*—Carl D. Price

*Attorney, Agent, or Firm*—Michael D. Bednarek; Marks & Murase

[57] ABSTRACT

Disclosed is a fuel gas supply adjuster which allows free adjustment of the flame length and enables stable flame length adjustment, for example in a gas lighter. In the fuel gas supply adjuster of the invention, a membrane filter which can provide a minimum necessary fuel retaining volume is used as the filter so as to prevent the fuel from being fed excessively at the initial ignition. Moreover, in order to incorporate the membrane filter in a fully sealed structure with a minimum necessary space being secured therein, one surface of the membrane filter is brought into close contact with that surface of an elastic member which has a conical recess, and the other surface thereof with the pressing face of a pressing member, while the other face of the elastic member with the fitting face of a base member, and the side face thereof with the side sealing face of the base member, respectively. Adjustment of the fuel gas supply is designed to be carried out by deforming the elastic member under compression with the pressing member.

9 Claims, 4 Drawing Sheets

FUEL GAS SUPPLY ADJUSTER

FIELD OF THE INVENTION

The present invention relates to a fuel gas supply adjuster in a gas lighter or igniter which utilizes directly the flame of a burning gas or in a combustion device such as a hair curler and an iron which utilizes the heat converted from the flame.

BACKGROUND OF THE INVENTION

Referring, for example, to the fuel gas supply adjusters (also referred to as flame length adjusters or flame adjusters) for gas lighters, there are known techniques as disclosed, for example, in Japanese Utility Model Publication No. 866/1972, Japanese Unexamined Utility Model Publication No. 154874/1979, Japanese Utility Model Publication No. 5562/1987 and Japanese Patent Publication No. 52770/1990.

As will be appreciated by reading these official gazettes, the mechanisms of controlling the gas supply can roughly be grouped into two types. The first one is of compression adjustment type, in which a porous elastic filter is compressed for flow rate adjustment (Japanese Unexamined Utility Model Publication No. 154874/1979 and Japanese Utility Model Publication No. 5562/1987); and the second one is of an area adjustment type, in which the gas permeating area of a noncompressible filter is changed for flow rate adjustment (Japanese Utility Model Publication No. 866/1972 and Japanese Patent Publication No. 52770/1990).

While the compression adjustment type flow rate adjuster is still now utilized frequently in the commercially available products, it suffers a problem in the stability of adjustment, as described in Japanese Utility Model Publication No. 866/1972 and Japanese Unexamined Utility Model Publication No. 154874/1979, due to the instability of the elastic filter employed therein which increases with time.

Meanwhile, the area adjustment type flow rate adjuster is free from such problem of increasing instability with time because adjustment can be achieved without affecting the filter itself, and thus the area adjustment type is theoretically expected to have superior adjusting function to the compression adjustment type.

However, the technique of Japanese Utility Model Publication No. 866/1972 has not yet been realized in actual products, although it has passed a considerable time since the technique was disclosed. It was proved by experiments using trial products fabricating according to the constitution as disclosed in Japanese Utility Model Publication No. 866/1972 that the gas flow rate is abnormally increased at the initial ignition after a predetermined time of interval to cause ignition failure, formation of abnormally long flame, flickering of the flame, poor adjustability and many other problems, and thus the theoretically expected adjusting function can not always sufficiently be exhibited.

Meanwhile, the technique disclosed in Japanese Patent Publication No. 52770/1990 can fully exhibit the merit of the area adjusting system and is realized in the commercially available products practically utilized. However, this technique merely enables automatic adjustment of the flame length (flame height) within a predetermined range and no consideration is given as for enabling free adjustment of the flame length as a user desires.

In view of the problems inherent in the prior art, the present inventor made extensive studies with a view to providing a supply adjuster which enables free adjustment of the flame length and can exhibit a stable adjusting function as can be expected in the area adjustment type flow rate adjuster. They made various experiments from different angles particularly on the technique of Japanese Utility Model Publication No. 866/1972 so as to analyze the causes of the problems mentioned above to assure themselves of the facts that the causes reside in the thickness of the filter, the relationship between the filter and the elastic body, and the relationship between the peripheral members for mounting or housing them.

The present inventor consequently came to know that free adjustment of the flame length becomes possible and that the stable adjusting function as can be expected in the area adjustment type flow rate adjuster can fully be exhibited by using a membrane filter which can provide a minimum necessary fuel retaining volume as the filter so as not to feed an excessive amount of fuel at the initial ignition and by incorporating the membrane filter in a fully shielded structure with a minimum necessary space being secured therein.

SUMMARY OF THE INVENTION

The present invention has been accomplished based on the finding as described above and it is an object of the invention to provide a supply adjuster which enables free adjustment of the flame length and can securely exhibit the stable adjusting function as can be expected in the area adjustment type flow rate adjuster.

More specifically, the fuel gas supply adjuster according to the present invention is directed to a fuel gas supply adjuster comprising a base member having a fuelling hole and a flat fitting face formed around the periphery at one open edge of said fuelling hole with a side sealing face standing around said fitting face; a planar elastic member having a conical recess with a fuelling hole being defined at the bottom so as to communicate to the fuelling hole of said base member; a membrane filter; a pressing member having a fuelling hole, communicating via said membrane filter to the fuelling hole of the elastic member, and a flat pressing face formed around one opening edge of the fuelling hole thereof; and an adjusting means for adjusting the pressing force of said pressing member against said elastic member; wherein said membrane filter and said elastic members are disposed between the pressing face of said pressing member and the fitting face of said base member in such a way that one surface of said membrane filter may be brought into close contact with that face of said elastic member which has the conical recess formed thereon and the other face with the pressing face of said pressing member, and that the other face of said elastic member with the fitting face of said base member and the side face of said elastic member with the side sealing face of said base member, respectively.

In the fuel gas supply adjuster according to the present invention, the elastic member is compressed or restored to change the area of the peripheral portion of the conical recess to be brought into contact with the membrane filter so as to change the fuel gas permeability thereof and achieve adjustment of the supply of the fuel gas.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DESCRIPTION OF PREFERRED EMBODIMENT

A preferred embodiment of the invention will now be described below.

Figure 1:
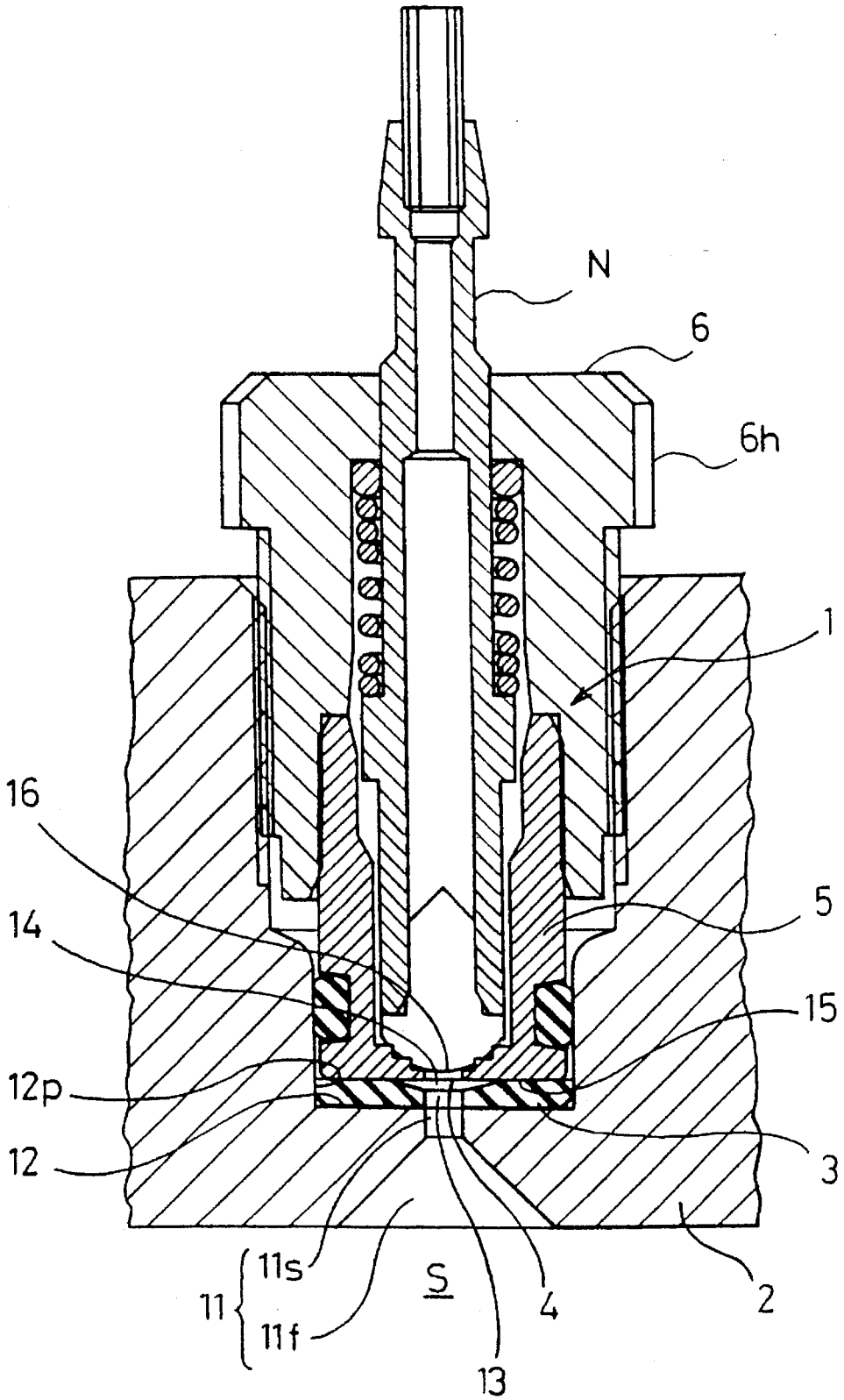
FIG. 1 shows in cross-sectional view the major portion of a lighter in which the fuel gas supply adjuster according to one embodiment of the present invention is incorporated.

The fuel gas supply adjuster 1 according to one preferred embodiment of the invention is applied to a so-called disposable lighter and comprises a base member 2, an elastic member 3, a membrane filter 4, a pressing member 5 and an adjusting means 6 as shown in FIG. 1 together with the partial view of the structure of the lighter.

The base member 2, which is serving as the member constituting the fuel tank of the lighter, has a fuelling hole 11 communicating to the fuel storage chamber S. The fuelling hole 11 consists of a conically expanded portion **11*f* which expands upstream or toward the fuel tank and a small-diameter round hole portion 11*s* formed contiguously downstream thereto. A flat fitting face 12 is provided around the downstream open end of the fuelling path with a side sealing face 12*p* standing upright around the fitting face 12**.

The elastic member 3 is of a planar disc-like shape which has a conical recess 14 with a fuelling hole 13 having a diameter substantially equal to that of the round hole portion **11*s* being defined in alignment with the fuelling hole 11 of the base member 2 and is made of a material such as rubber so as to be able to undergo compressive deformation when pressed by the pressing member 5. The elastic member 3 is disposed in such a way that the flat face (the face opposite to that having the conical recess 14) and the side face thereof will be in close contact with the fitting face 12 of the base member 2 and the side sealing face 12*p* of the base member 2, respectively, in other words, there will be left no clearance between these two faces and the fitting face 12 and the side sealing face 12*p***, respectively.

The membrane filter 4 is of a microporous film having a thickness of about 25 microns and micropores with a diameter of ranging from several microns to 1 micron or less over the entire surfaces. A polypropylene film marketed under the trade name of "Celguard" by Daicel Chemical Industries, Ltd. was used in this embodiment. Celguard has micropores with a diameter of about 0.1 micron which are relatively straight, and the structure of the micropores is very well suited as the filter for adjusting fuel gas supply. Particularly, Celguard can introduce the fuel even from a gaseous phase based on the capillary phenomenon and retain it therein, so that the wick for fuel-sucking as described in Japanese Unexamined Utility Model Publication No. 154874/1979 can be omitted, leading to cost reduction, advantageously (see Japanese Patent Publication No. 52770/1990).

The membrane filter 4, like the elastic member 3, is also brought into contact at one surface with the flat portion formed around the conical recess 14 of the elastic member 3 and the other surface with a pressing face 15 (to be described later) of the pressing member 5 so as to leave no clearance therebetween, respectively.

The pressing member 5 is of a cylindrical form having an open end and a closed end which has at the center a fuelling hole 16 with a diameter substantially equal to that of the fuelling hole 13 of the elastic member 3. A flat pressing face 15 is formed around the upstream end side of the fuelling hole 16, and the upstream portion of a burner nozzle N is fitted and housed in the pressing member 5.

The adjusting means 6 is screwed into the base member 2 and can be shifted vertically by turning the head **6*h* thereof. The state of pressing the elastic member 3 by the pressing member 5 can be changed depending on the vertical shift of the adjusting means 6**.

Adjustment of the fuel gas supply in the fuel gas supply adjuster 1 having such structure is carried out in the following manner.

Figure 2:
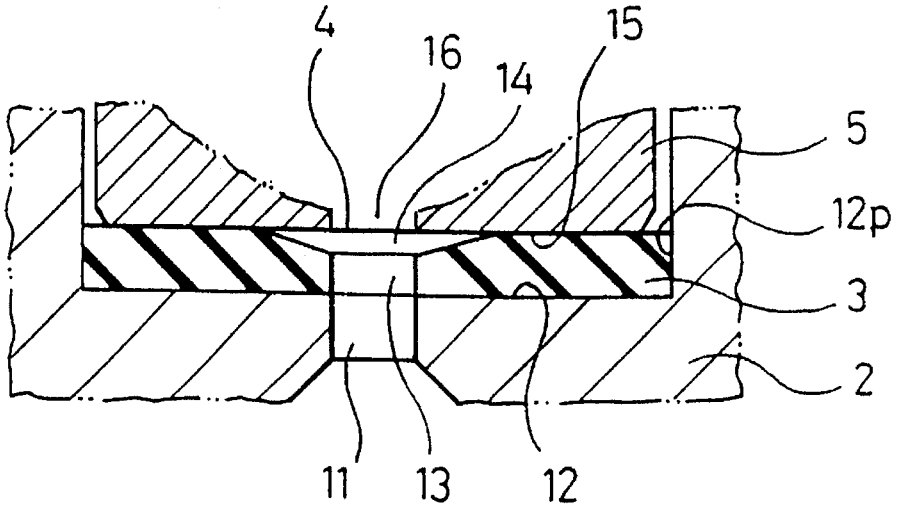
FIG. 2 shows partly in enlarged view the relationship between the elastic member and the membrane filter.
Figure 3:
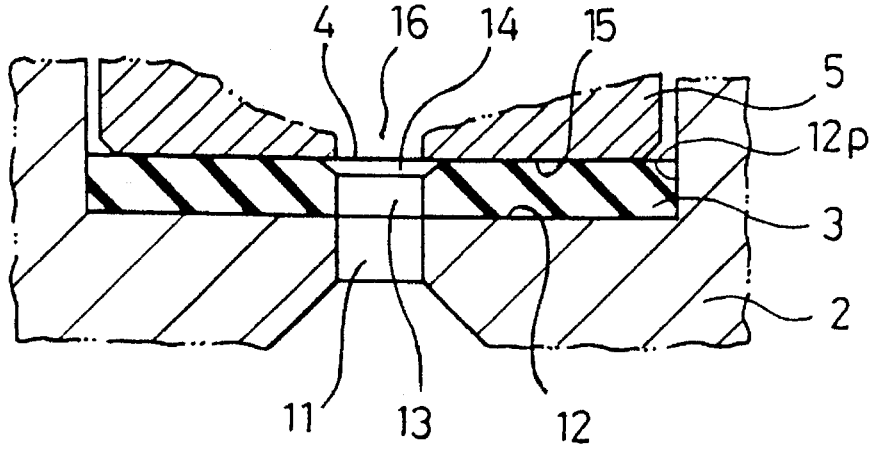
FIG. 3 shows partly in enlarged view the relationship between the elastic member under compression and the membrane filter.

While the fuel gas is fed finally to the burner nozzle N through the fuel ling hole 11 of the base member 2, the fuel ling hole 13 of the elastic member 3, the conical recess 14, the membrane filter 4 and the fuelling hole 16 of the pressing member 5 in this order under the normal burning state, the supply of the gas is determined depending on the area of the peripheral portion of the conical recess 14 to be brought into contact with the membrane filter 4. Accordingly, the area of the peripheral portion of the conical recess 14 to be brought into contact with the membrane filter 4 can be varied by compressing or restoring the elastic member 3 under adjustment of the pressing force of the pressing member 5 through the adjusting means 6, and thus the flow rate of the fuel gas can be adjusted (FIGS. 2 and 3). The adjustment resorting to the change in the contact area shall not necessarily be appreciated to be the change in the area of the membrane filter 4 through which the fuel gas can pass, or the change in the degree of shielding the gas path. In other words, since the three fuelling holes 11,13,16 have substantially equal diameters and besides the conical recess 14 has a largest diameter which is greater than those of these fuel ling holes 11,13, 16, the change in the contact area cannot necessarily be connected directly to the change in the shielding degree.

The initial ignition, which is of the greatest concern, can be effected using the fuel retained preliminarily in the micropores of the membrane filter 4, and thus stable initial ignition can constantly be obtained. Namely, the membrane filter 4 is designed to be compressed to a thickness sufficient to provide an optimum degree of fuel retaining volume at the initial ignition to be stable to change with time and to maintain the fuel retaining volume in an optimum state. Besides, the membrane filter 4 and the elastic member 3 are shielded in such a state that there will be left no clearance except for the minimum necessary space, i.e. the fuelling holes 11,13,16 and the conical recess 14, as described above, stable initial ignition can constantly be given with neither ignition failure nor abnormal increase in the gas flow rate to form abnormally long flame.

It should be noted here that it is true that the shielding of the elastic member 3 and the membrane filter 4 with the fitting face 12 and the side sealing face **12*p* of the base member 2 as well as with the pressing face 15 of the pressing member 5** contributes to the stable initial ignition, but this effect happened to be found in the repeated laboratory works and the technological mechanism thereof has not yet been elucidated.

Figure 4:
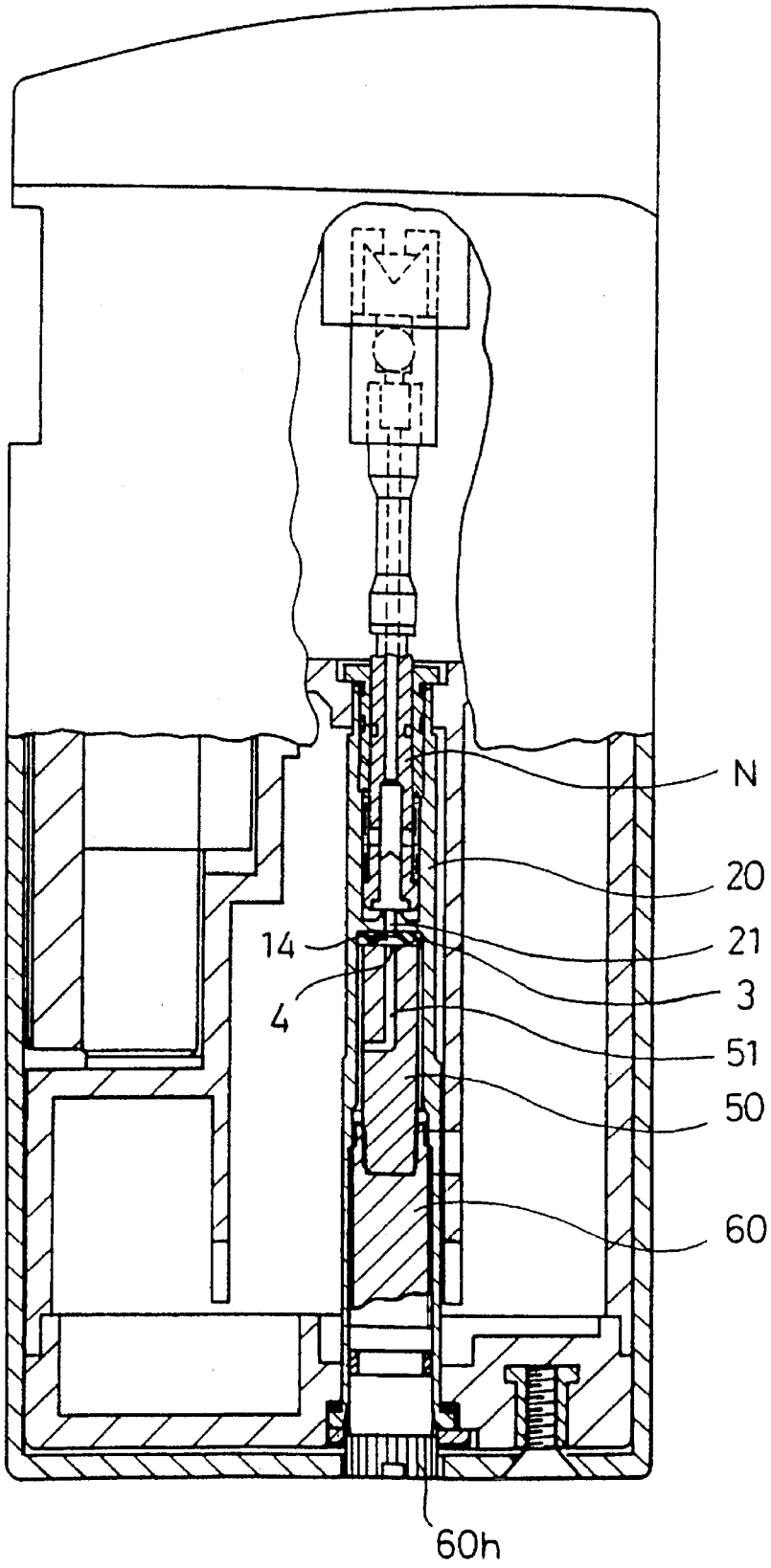
FIG. 4 shows in cross-sectional view a lighter in which the fuel supply adjuster according to another embodiment of the invention is incorporated.
Figure 5:
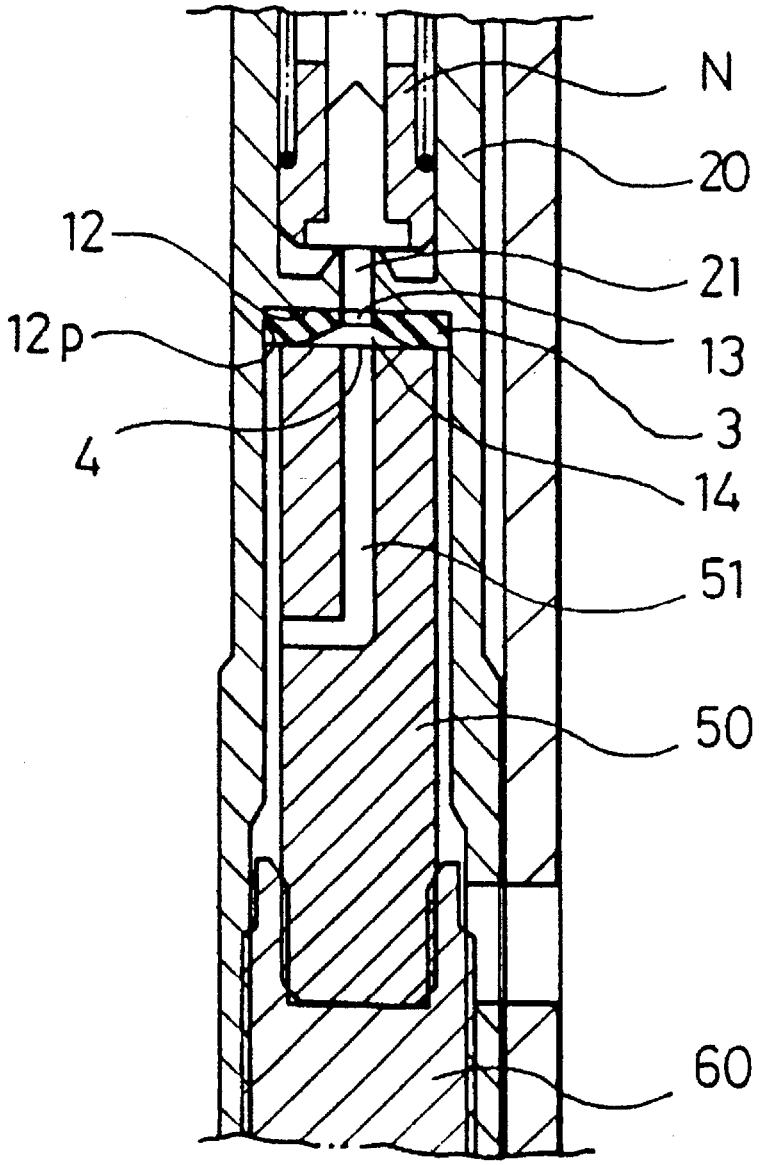
FIG. 5 shows in enlarged view the major portion of the lighter shown in FIG. 4.

FIGS. 4 and 5 show a second embodiment of the invention applied to a widespread lighter which is not of disposable type, the structure of which is an inversion of the first embodiment. More specifically, in the first embodiment, the base member 2 is disposed upstream with the fuelling hole 11 thereof being connected to the fuel tank and the pressing member 5 is disposed downstream with the fuelling hole 16 communicating to the burner nozzle N. However, in the second embodiment, a pressing member 50 is disposed upstream with the fuelling hole 51 communicating to the fuel tank, and a base member 20 is disposed downstream with the fuelling hole 21 communicating to the burner nozzle N. An adjusting means 60 is disposed downstream the pressing member 50 in such a way that the operation member 60h thereof may be exposed at the lower end of the fuel tank. The other members which are substantially equal to those of the first embodiment are denoted correspondingly by the same numbers and description therefor will be omitted.

CAPABILITY OF EXPLOITATION IN INDUSTRY

As has been described above, in the fuel gas supply adjuster according to this invention, a membrane filter which can provide a minimum necessary fuel retaining volume is employed as the filter, and besides the membrane filter and the elastic member for controlling gas permeability of the membrane filter are designed to be incorporated in a fully sealed structure except for the minimum necessary space. Accordingly, the flame length can be freely adjusted, and the stable adjusting function as expected for the area adjustment type can be securely exhibited. When the fuel gas supply adjuster is applied, for example, to a lighter, an easier and safer lighter is provided.

What is claimed is:

1. A fuel gas supply adjuster comprising:

a base member having a fueling hole and a flat fitting face formed around a periphery of one open edge of said fueling hole with a side sealing face standing around said fitting face;

a planar elastic member having a first face with a conical recess formed thereon, said conical recess having a fueling hole defined at a bottom of the recess so as to communicate to the fueling hole of said base member;

a membrane filter;

a pressing member having a fueling hole and a flat pressing face formed around one opening edge of the fueling hole; and an adjusting means for adjusting a pressing force of said pressing member against said elastic member;

wherein said membrane filter and said elastic member are disposed between the pressing face of said pressing member and the fitting face of said base member in such a way that a first surface of said membrane filter is brought into close contact with said first face of said elastic member which has the conical recess formed thereon, a second surface of said membrane filter is brought into close contact with the pressing face of said pressing member, a second face of said elastic member is brought into close contact with the fitting face of said base member, and a side face of said elastic member is brought into close contact with the side sealing face of said base member, respectively.

2. A fuel gas supply adjuster, comprising:

a base member having a first fueling hole and a sealing face formed around a periphery of said first fueling hole;

an elastic member having a first face in engagement with the sealing face of said base member, a second face with a conical recess formed therein, and a second fueling hole extending between the first and second faces of said elastic member, said second fueling hole being generally concentric with said conical recess and in fluid communication with the first fueling hole of said base member;

a membrane filter having first and second surfaces, the first surface being in close contact with the second face of said elastic member and in fluid communication with the second fueling hole;

a pressing member having a third fueling hole and a flat pressing face formed around the periphery of said third fueling hole, said flat pressing face being in close contact with the second surface of said membrane filter, said third fueling hole being in fluid communication with the second surface of said membrane filter and having a diameter that is substantially equal to a diameter of said second fueling hole; and adjusting means for adjusting a pressing force of said pressing member against the second surface of said membrane filter for deforming the elastic member and changing a dimension of said conical recess;

wherein said elastic member further comprises a side wall about an outer periphery of said elastic member, said base member further comprises a side sealing face, and said side wall of the elastic member is in sealing contact with said side sealing face of the base member.

3. The fuel gas supply adjuster of claim 2, wherein said second and third fueling holes are generally concentric.

4. The fuel gas supply adjuster of claim 3, wherein said first fueling hole is generally concentric with said second and third fueling holes.

5. The fuel gas supply adjuster of claim 2, wherein said first fueling hole has a diameter that is substantially equal to the diameter of said second fueling hole and the diameter of said third fueling hole.

6. The fuel gas supply adjuster of claim 2, wherein said first, second, and third fueling holes form a fuel flow path through the gas supply adjuster, said first fueling hole being upstream from said second and third fueling holes.

7. The fuel gas supply adjuster of claim 2, wherein said first, second, and third fueling holes form a fuel flow path through the gas supply adjuster, said first fueling hole being downstream from said second and third fueling holes.

8. The fuel gas supply adjuster of claim 2, wherein said membrane filter comprises a microporous film.

9. The fuel gas supply adjuster of claim 8, wherein said microporous film has a thickness of about 25 microns and micropores with a diameter of 1 micron or less.

* * * * *